US011649702B2

(12) United States Patent
Alruwaili et al.

(10) Patent No.: US 11,649,702 B2
(45) Date of Patent: May 16, 2023

(54) WELLBORE SHAPED PERFORATION ASSEMBLY

(71) Applicants: Saudi Arabian Oil Company, Dhahran (SA); Schlumberger Middle East, S.A., Dubai (AE)

(72) Inventors: Khalid Mohammed M. Alruwaili, Dhahran (SA); Murtadha J. AlTammar, Riyadh (SA); Gallyam Aidagulov, Dhahran (SA); Devon Chikonga Gwaba, Kennesaw, GA (US); Abbad Mustapha, Khobar (SA)

(73) Assignees: Saudi Arabian Oil Company, Dhahran (SA); Schlumberger Middle East, S.A., Dubai (AE)

( * ) Notice: Subject to any disclaimer, the term of this patent is extended or adjusted under 35 U.S.C. 154(b) by 134 days.

(21) Appl. No.: 17/111,225

(22) Filed: Dec. 3, 2020

(65) Prior Publication Data

US 2022/0178229 A1 Jun. 9, 2022

(51) Int. Cl.

| | |
|---|---|
| ***E21B 43/117*** | (2006.01) |
| ***E21B 29/00*** | (2006.01) |
| ***E21B 43/114*** | (2006.01) |

(52) U.S. Cl.

CPC ..... *E21B 43/117* (2013.01); *E21B 29/00* (2013.01); *E21B 43/114* (2013.01)

(58) Field of Classification Search

CPC ..... E21B 43/117; E21B 43/114; E21B 43/26; E21B 43/116; E21B 43/119; E21B 43/27; E21B 29/00

See application file for complete search history.

(56) References Cited

U.S. PATENT DOCUMENTS

| | | | |
|---|---|---|---|
| 2,688,369 | A | 9/1954 | Broyles |
| 2,699,212 | A | 1/1955 | Dismukes |

(Continued)

FOREIGN PATENT DOCUMENTS

| | | |
|---|---|---|
| CN | 101726223 | 6/2010 |
| EA | 004186 | 2/2004 |

(Continued)

OTHER PUBLICATIONS

Abad et al., "Evaluation of the Material Properties of the Multilayered Oxides formed on HCM12A using New and Novel Techniques," Manuscript No. OXID-D-15-00019, Manuscript Draft, 2015, 44 pages.

(Continued)

*Primary Examiner* — Yong-Suk (Philip) Ro
(74) *Attorney, Agent, or Firm* — Fish & Richardson P.C.

(57) ABSTRACT

A well tool for generating a shaped perforation in a cased wellbore includes a tool body. The told body has at least one wall, a fluid channel, a first perforation device, and a second perforation device. The at least one wall defines an opening and an interior volume. The fluid channel extends from the opening of the at least one wall into the interior volume. The first perforation device is configured to form a perforation tunnel in the cased wellbore disposed in a formation. The second perforation device is coupled to the first perforation device and to the fluid channel. The second perforation device is configured to form the shaped perforation in the formation by flowing fluid received through the fluid channel to the formation through the perforation tunnel.

24 Claims, 4 Drawing Sheets

(56) References Cited

U.S. PATENT DOCUMENTS

| | | | | |
|---|---|---|---|---|
| 2,758,653 | A | 8/1956 | Desbrow | |
| 3,050,122 | A | 8/1962 | Huitt et al. | |
| 3,118,501 | A | 1/1964 | Kenley | |
| 3,211,221 | A | 10/1965 | Huitt | |
| 3,254,720 | A | 8/1966 | Huitt | |
| 3,313,348 | A | 4/1967 | Huitt et al. | |
| 3,331,439 | A | 7/1967 | Lawrence | |
| 4,220,550 | A | 9/1980 | Frenier et al. | |
| 4,262,745 | A | 4/1981 | Stewart | |
| 4,289,639 | A | 9/1981 | Buske | |
| 4,381,950 | A | 5/1983 | Lawson | |
| 4,390,067 | A | 6/1983 | Willman | |
| 4,629,702 | A | 12/1986 | Fan et al. | |
| 4,662,440 | A | 5/1987 | Harmon | |
| 4,687,061 | A | 8/1987 | Uhri | |
| 4,754,808 | A | 7/1988 | Harmon | |
| 4,756,371 | A * | 7/1988 | Brieger | E21B 37/00 175/4.51 |
| 4,809,793 | A | 3/1989 | Hailey | |
| 4,974,675 | A | 12/1990 | Austin et al. | |
| 5,016,710 | A | 5/1991 | Renard | |
| 5,060,738 | A | 10/1991 | Pittard et al. | |
| 5,074,360 | A | 12/1991 | Guinn | |
| 5,111,881 | A | 5/1992 | Soliman et al. | |
| 5,228,510 | A | 7/1993 | Jennings, Jr. | |
| 5,251,286 | A | 10/1993 | Wiener et al. | |
| 5,277,062 | A | 1/1994 | Blauch et al. | |
| 5,450,902 | A | 9/1995 | Matthews | |
| 5,517,854 | A | 5/1996 | Plumb et al. | |
| 5,735,359 | A | 4/1998 | Lee et al. | |
| 5,999,887 | A | 12/1999 | Giannakopoulos et al. | |
| 6,095,244 | A | 8/2000 | Graham | |
| 6,119,776 | A | 9/2000 | Graham et al. | |
| 6,140,816 | A | 10/2000 | Heron et al. | |
| 6,279,670 | B1 | 8/2001 | Eddison et al. | |
| 6,425,448 | B1 | 7/2002 | Zupanick | |
| 6,488,087 | B2 | 12/2002 | Longbottom | |
| 6,516,080 | B1 | 2/2003 | Nur | |
| 6,694,262 | B2 | 2/2004 | Rozak | |
| 6,729,394 | B1 | 5/2004 | Hassan | |
| 6,843,233 | B2 | 1/2005 | Berger et al. | |
| 6,866,048 | B2 | 3/2005 | Mattox | |
| 7,369,980 | B2 | 5/2008 | Deffenbaugh et al. | |
| 7,370,696 | B2 | 5/2008 | Al-Muraikhi | |
| 7,419,005 | B2 | 9/2008 | Al-Muraikhi | |
| 7,472,748 | B2 | 1/2009 | Gdanski et al. | |
| 7,637,316 | B2 | 12/2009 | Best | |
| 7,828,063 | B2 | 11/2010 | Olsen et al. | |
| 8,041,510 | B2 | 10/2011 | Dasgupta | |
| 8,081,802 | B2 | 12/2011 | Dvorkin et al. | |
| 8,265,915 | B2 | 9/2012 | Hsu et al. | |
| 8,380,437 | B2 | 2/2013 | Abousleiman et al. | |
| 8,490,685 | B2 | 7/2013 | Tolman | |
| 8,606,524 | B2 | 12/2013 | Soliman et al. | |
| 8,614,573 | B2 | 12/2013 | Minh | |
| 8,631,872 | B2 | 1/2014 | East | |
| 8,731,889 | B2 | 5/2014 | Du et al. | |
| 8,868,385 | B2 | 10/2014 | Fertig et al. | |
| 8,967,249 | B2 | 3/2015 | Akkurt et al. | |
| 9,046,509 | B2 | 6/2015 | Dvorkin et al. | |
| 9,063,252 | B2 | 6/2015 | Kamal | |
| 9,097,818 | B2 | 8/2015 | Hursan | |
| 9,187,992 | B2 | 11/2015 | Cherian | |
| 9,416,636 | B2 * | 8/2016 | Myhre | E21B 33/13 |
| 9,784,085 | B2 | 10/2017 | Liu et al. | |
| 10,301,904 | B2 * | 5/2019 | Larsen | E21B 33/14 |
| 10,351,758 | B2 | 7/2019 | Hull et al. | |
| 10,415,367 | B2 | 9/2019 | Galford | |
| 10,612,355 | B1 | 4/2020 | Alruwaili et al. | |
| 2005/0060130 | A1 | 3/2005 | Shapiro et al. | |
| 2007/0051517 | A1 | 3/2007 | Suijaatmadja et al. | |
| 2007/0203677 | A1 | 8/2007 | Awwiller | |
| 2008/0179060 | A1 | 7/2008 | Surjaatmadja et al. | |
| 2008/0210427 | A1 | 9/2008 | Ziauddin et al. | |
| 2008/0264640 | A1 | 10/2008 | Eslinger | |
| 2009/0193881 | A1 | 8/2009 | Finnberg | |
| 2009/0266548 | A1 | 10/2009 | Olsen et al. | |
| 2009/0288833 | A1 | 11/2009 | Graham et al. | |
| 2010/0128982 | A1 | 5/2010 | Dvorkin et al. | |
| 2010/0186520 | A1 | 7/2010 | Wheeler | |
| 2010/0213579 | A1 | 8/2010 | Henry | |
| 2010/0279136 | A1 | 11/2010 | Bonucci | |
| 2011/0017458 | A1 | 1/2011 | East et al. | |
| 2011/0067870 | A1 | 3/2011 | East | |
| 2011/0284214 | A1 | 11/2011 | Ayoub et al. | |
| 2012/0150515 | A1 | 6/2012 | Hariharan et al. | |
| 2013/0032349 | A1 | 2/2013 | Alekseenko et al. | |
| 2013/0199787 | A1 | 8/2013 | Dale et al. | |
| 2013/0248192 | A1 | 9/2013 | Cook | |
| 2014/0048694 | A1 | 2/2014 | Pomerantz | |
| 2014/0069653 | A1 | 3/2014 | Liu et al. | |
| 2014/0078288 | A1 | 3/2014 | Wu | |
| 2014/0352968 | A1 | 12/2014 | Pitcher | |
| 2015/0096806 | A1 | 4/2015 | Fonseca Ocampos | |
| 2015/0136388 | A1 | 5/2015 | Fehr et al. | |
| 2015/0176362 | A1 | 6/2015 | Hariharan et al. | |
| 2015/0293256 | A1 | 10/2015 | Dusterhoft | |
| 2016/0201440 | A1 | 7/2016 | Aidagulov | |
| 2016/0203239 | A1 | 7/2016 | Samuel et al. | |
| 2017/0030188 | A1 | 2/2017 | Lehr | |
| 2017/0067836 | A1 | 3/2017 | Hull et al. | |
| 2017/0176639 | A1 | 6/2017 | Mosse et al. | |
| 2017/0248011 | A1 | 8/2017 | Craddock et al. | |
| 2018/0119533 | A1 | 5/2018 | Alhuthali | |
| 2018/0119535 | A1 | 5/2018 | Shen et al. | |
| 2018/0266183 | A1 | 9/2018 | Ayub | |
| 2018/0321416 | A1 | 11/2018 | Freedman | |
| 2018/0371903 | A1 | 12/2018 | Li et al. | |
| 2019/0112912 | A1 | 4/2019 | Thompson et al. | |
| 2019/0195043 | A1 | 6/2019 | Singh | |
| 2019/0218907 | A1 | 7/2019 | Ow | |
| 2019/0226956 | A1 | 7/2019 | Alruwaili et al. | |
| 2020/0024935 | A1 | 1/2020 | Eitschberger et al. | |
| 2020/0024936 | A1 | 1/2020 | Chang | |
| 2020/0115997 | A1 | 4/2020 | Stang et al. | |
| 2020/0173249 | A1 | 6/2020 | Fairweather | |

FOREIGN PATENT DOCUMENTS

| | | |
|---|---|---|
| EP | 0460927 | 2/1993 |
| EP | 0474350 | 9/1994 |
| RU | 2211318 | 8/2003 |
| SU | 1036926 | 8/1983 |
| SU | 1680925 | 9/1991 |
| SU | 1709055 | 1/1992 |
| WO | WO 2010008684 | 1/2010 |
| WO | WO 2010074581 | 7/2010 |
| WO | WO 2010083166 | 7/2010 |
| WO | WO 2014116305 | 7/2014 |
| WO | WO 2014178504 | 11/2014 |
| WO | WO 2016094153 | 6/2016 |
| WO | WO 2017065331 | 4/2017 |
| WO | WO 2017078674 | 5/2017 |
| WO | WO 2018174987 | 9/2018 |
| WO | WO 2018175394 | 9/2018 |
| WO | WO 2019064041 | 4/2019 |

OTHER PUBLICATIONS

Abousleiman et al., "A Micromechanically Consistent Poroviscoelasticity Theory for Rock Mechanics Applications," International Journal of Rock Mechanics and Mining Services & Geomechanics, Abstracts, 1993, 30:7 (1177-1180), 4 pages.

Abousleiman et al., "Anisotropic Porothermoelastic Solution and Hydro-Thermal Effects on Fracture Width in Hydraulic Fracturing," International Journal for Numerical and Analytical Methods in Geomechanics, 2013, 25 pages.

Abousleiman et al., "GeoGenome Industry Consortium (G2IC)," JIP, 2004-2006, 6 pages.

Abousleiman et al., "Geomechanics Field and Laboratory Characterization of Woodford Shale: The Next Gas Play," SPE 110120, Society of Petroleum Engineers (SPE), presented at the 2007 SPE

(56) References Cited

OTHER PUBLICATIONS

Annual Technical Conference and Exhibition on Nov. 11-14, 2007, 14 pages.
Abousleiman et al., "Geomechanics Field Characterization of the Two Prolific U.S. Mid-West Gas Plays with Advanced Wire-Line Logging Tools," SPE 124428, Society of Petroleum Engineers (SPE), presented at 2009 SPE Annual Technical Conference and Exhibition, Oct. 4-7, 2009, 19 pages.
Abousleiman et al., "Mandel's Problem Revisited," Geotechnique, 1996, 46:2 (187-195), 9 pages.
Abousleiman et al., "Mechanical Characterization of Small Shale Samples subjected to Fluid Exposure using the Inclined Direct Shear Testing Device," International Journal of Rock Mechanics and Mining Sciences, 2010, 47:3 (355-367), 13 pages.
Abousleiman et al., "Poroelastic Solutions in Transversely Isotropic Media for Wellbore and Cylinder," PPI: S0020-7683(98)00101-2, International Journal of Solids Structures, 1998, 35:34-35 (4905-4929), 25 pages.
Abousleiman et al., "Poroviscoelastic Analysis of Borehole and Cylinder Problems," ACTA Mechanica, 1996, 119: 199-219, 21 pages.
Abousleiman et al., "The Granular and Polymer Nature of Kerogen Rich Shale," Acta Geotechnica, Feb. 2016, 24 pages.
Aidagulov et al., "Model of Hydraulic Fracture Initiation from the Notched Open hole," SPE-178027-MS, Society of Petroleum Engineers (SPE), presented at the SPE Saudi Arabia Section Annual Technical Symposium and Exhibition, Apr. 21-23, 2015, 13 pages.
Aidagulov et al., "Notching as a New Promising Well Intervention Technique to Control Hydraulic Fracturing in Horizontal Open Holes," AAPG Datapages/Search and Discovery Article #90254, American Association of Petroleum Geologists (AAPG), presented at the 12th Middle East Geosciences Conference and Exhibition GEO-2016, Mar. 7-10, 2016.
Allan et al., "A Multiscale Methodology for the Analysis of Velocity Anisotropy in Organic-Rich Shale," Geophysics, Jul.-Aug. 2015, 80:4 (C73-C88), 16 pages.
Al-Qahtani et al., "A Semi-Analytical Model for Extended-Reach Wells with Wellbore Flow Splitting; a Production Optimization Scheme," SPE-177931, Society of Petroleum Engineers (SPE), presented at the Abu Dhabi International Petroleum Exhibition and Conference, Nov. 9-12, 2015, 21 pages.
Al-Yami et al., "Engineered Fit-for-Purpose Cement System to Withstand Life-of-the-Well Pressure and Temperature Cycling," SPE-188488-MS, Society of Petroleum Engineers (SPE), presented at the Abu Dhabi International Petroleum Exhibition & Conference, Nov. 2017, 14 pages.
Ananthan et al., "Influence of Strain Softening on the Fracture of Plain Concrete Beams," International Journal of Fracture, 1990, 45: 195-219, 25 pages.
Apageo.com [online], "Ménard Pressuremeter Pressuremeter test according," 2016, retrieved on Oct. 7, 2019, retrieved from URL <https://www.apageo.com/en/3/products%2Cpressuremeter-tests%2Cmenard-pressuremeter%2C14%2C5.html>, 2 pages.
Arns et al., "Computation of linear elastic properties from microtomographic images: Methodology and agreement between theory and experiment," Geophysics, Sep.-Oct. 2002, 67:5 (1396-1405), 10 pages.
Azizi et al., "Design of Deep Foundations Using the Pressuremeter Method," Proceedings of the Sixth International Offshore and Polar Engineering Conference, Los Angeles, May 1996, The International Offshore and Polar Engineers, 1, 9 pages.
Ballice, "Solvent Swelling Studies of Goynuk (Kerogen Type-I) and Beypazari Oil Shales (Kerogen Type-II)," Science Direct, Fuel, 2003, 82: 1317-1321, 5 pages.
Bazant et al., "Deformation of Progressively Cracking Reinforced Concrete Beams," Title No. 81-26, ACI Journal, Technical Paper, May-Jun. 1984, 81:3, 11 pages.
Bazant et al., "Strain-Softening Bar and Beam: Exact Non-Local Solution," International Journal of Solids Structures, 1988, 24:7 (659-673), 15 pages.
Benafan et al., "Shape Memory Alloy Rock Splitters (SMARS)—A Non-Explosive Method for Fracturing Planetary Rocklike Materials and Minerals," NASA/TM-2015-218832, NASA STI Program, Jul. 2015, 42 pages.
Bennett et al., "Instrumented Nanoindentation and 3D Mechanistic Modeling of a Shale at Multiple Scales," Acta Geotechnica, Jan. 2015, 10:21, 14 pages.
Berger et al., "Effect of eccentricity, voids, cement channels, and pore pressure decline on collapse resistance of casing," SPE-90045-MS, Society of Petroleum Engineers (SPE), presented at the SPE Annual Technical Conference and Exhibition, Sep. 26-29, 2004, 8 pages.
Bhandari et al., "Two-Dimensional DEM Analysis of Behavior of Geogrid-Reinforced Uniform Granular Bases under a Vertical Cyclic Load," Acta Geotechnica 10:469-480, 2014, 12 pages.
Biot, "General Theory of Three-Dimensional Consolidation," The Ernest Kempton Adams Fund for Physical Research of Columbia University, Reprint Series, Journal of Applied Physics, Feb. 1941, 12:2, 11 pages.
Bobko et al., "The Nanogranular Origin of Friction and Cohesion in Shale—A Strength Homogenization Approach to Interpretation of Nanoindentation Results," International Journal for Numerical Analytical Method in Geomechanics, 2010, 23 pages.
Boskey et al., "Perspective—Collagen and Bone Strength," Journal of Bone and Mineral Research, 1999, 14:3, 6 pages.
Bourbie and Zinszner, "Hydraulic and Acoustic Properties as a Function of Porosity in Fontainebleau Sandstone," Journal of Geophysical Research, 90:B13 (11524-11532), Nov. 1985, 9 pages.
Cai et al., "Experimental Investigation on Perforation of Shale with Ultra-High Pressure Abrasive Water Jet: Spake, Mechanism and Sensitivity," Journal of Natural Gas Science and Engineering, Jul. 2019, 67: 196-213, 18 pages.
Chang et al, "Multiple Fracture Initiation in Openhole without Mechanical Isolation: First Step to Fulfill an Ambition," SPE 168638, Society of Petroleum Engineers (SPE), presented at the SPE Hydraulic Fracturing Technology Conference, Feb. 4-6, 2014, 18 pages.
Chen et al., "Size Effect in Micro-Scale Cantilever Beam Bending," Acta Mech., 2011, 219: 291-307, 17 pages.
Chern et al., "Deformation of Progressively Cracking Partially Prestressed Concrete Beams," PCI Journal, Jan.-Feb. 1992, 37:1, 11 pages.
Chupin et al., "Finite Strain Analysis of Nonuniform Deformation Inside Shear Bands in Sands," International Journal for Numerical and Analytical Methods in Geomechanics, 2012, 36: 1651-1666, 16 pages.
Deirieh et al., "Nanochemomechanical Assessment of Shale: A Coupled WDS-Indentation Analysis," Acta Geotechnica, 2012, 25 pages.
Devarapalli et al., "Micro-CT and FIB-SEM imaging and pour structure characterization of dolomite rock at multiple scales," Arabian Journal of Geosciences, Aug. 2017, 9 pages, abstract only.
Dvorkin, "Kozeny-Carman Equation Revisited," 2009, 16 pages.
Ekbote et al., "Porochemoelastic Solution for an Included Borehole in a Transversely Isotropic Formation," Journal of Engineering Mechanics, ASCE, Jul. 2006, 10 pages.
Ertas et al., "Petroleum Expulsion Part 1. Theory of Kerogen Swelling in Multicomponent Solvents," Energy & Fuels, 2006, 20: 295-300, 6 pages.
Ewy, "Shale Swelling/Shrinkage and Water Content Change due to Imposed Suction and Due to Direct Brine Contact," Acta Geotechnica, 2014, 9: 869-886, 18 pages.
Finney, "Random packings and the structure of simple liquids I. The geometry of random close packing," Proceedings of the Royal Society A, May 1970, 319: 479-493, 15 pages.
Frazer et al., "Localized Mechanical Property Assessment of SiC/SiC Composite Materials," Science Direct, Composites: Part A, 2015, 70: 93-101, 9 pages.
Gao et al., "Materials Become Insensitive to Flaws at Nanoscale: Lessons from Nature," Proceedings of the National Academy of Sciences, PNAS, May 2003, 100:10 (5597-55600), 4 pages.

(56) References Cited

OTHER PUBLICATIONS

Garnero, "The Contribution of Collagen Crosslinks to Bone Strength," International Bone & Mineral Society, BoneKEy Reports, Sep. 2012, 1: 182, 8 pages.
Georgi et al., "Physics and Chemistry in Nanoscale Rocks," Society of Petroleum Engineers (SPE), SPE Forum Series, Frontier of Technology, Mar. 22-26, 2015, La Jolla, California, USA, 4 pages.
Goodman, "Chapter 3: Rock Strength and Failure Criteria," in Introduction to Rock Mechanics, John Wiley & Sons, 21 pages.
Han et al., "Impact of Depletion on Integrity of Sand Screen in Depleted Unconsolidated Sandstone Formation," ARMA-2015-301, American Rock Mechanics Association, (ARMA), presented in the 49th US Rock Mechanics/Geomechanics Symposium. American Rock Mechanics Association, Jun.-Jul. 2015, 9 pages.
Han et al., "LBM-DEM Modeling of Fluid-Solid Interaction in Porous Media," International Journal for Numerical and Analytical Methods in Geomechanics, 2013, 37: 1391-1407, 17 pages.
Han et al., "Numerical Modeling of Elastic Hemispherical Contact for Mohr-Coulomb Type Failures in Micro-Geomaterials," Experimental Mechanics, Jun. 2017, 57: 1091-1105, 14 pages.
Hay, "Development of an Insitu Rock Shear Testing Device," Dissertation for the Degree of Doctor of Philosophy, University of Florida, Graduate School, 2007, 67 pages.
Hirata et al., "Estimation of Damaged Region Around a Tunnel By Compact VSP Probe Using Super Elastic Alloy," 9th IRSM Congress, International Society for Rock Mechanics, Jan. 1999, 4 pages.
Hoang et al., "Correspondence Principle Between Anisotropic Poroviscoelasticity and Poroelasticity using Micromechanics and Application to Compression of Orthotropic Rectangular Strips," Journal of Applied Physics, American Institute of Physics, Aug. 2012, 112:044907, 16 pages.
Hornby et al., "Anisotropic Effective-Medium Modeling of the Elastic Properties of Shales," Geophysics, Oct. 1994, 59:10 (1570-1583), 14 pages.
Hosemann et al., "Mechanical Characteristics of SiC Coating Layer in TRISO Fuel Particles," Journal of Nuclear Materials, 2013, 442: 133-142, 10 pages.
Hosemann et al., "An Exploratory Study to Determine Applicability of Nano-Hardness and Micro-compression Measurements for Yield Stress Estimation," Science Direct, Journal of Nuclear Materials, 2008, 375: 135-143, 9 pages.
Huang et al., "Pressuremeter Tests In Poorly Cemented Weak Rocks," Rock Mechanics for Industry, Amadei, Kranz, Scott and Smealtie (eds), 1999, 6 pages.
Huang et al., "A theoretical study of the critical external pressure for casing collapse" Journal of Natural Gas Science and Engineering, Nov. 2015, 27:1 (1-8), 8 pages.
Huang et al., "Collapse strength analysis of casing design using finite element method," International Journal of Pressure Vessels and Piping 2000, 77:359-367, 8 pages.
Hull et al., "Oxidative Kerogen Degradation: A Potential Approach to Hydraulic Fracturing in Unconventionals," Energy Fuels 2019, 33:6 (4758-4766), 9 pages.
Iqbal et al., "In situ micro-cantilver tests to study fracture properties of NiAl single crystals," Acta Materialia, Feb. 2012, 60:3 (1193-1200), 8 pages.
Itascag.com [online], "Three-dimensional Fast Lagrangian Analysis of Continua (FLAC3D)," available on or before 2012, [retrieved on Jun. 7, 2018], retrieved from URL: < https://www.itascacg.com/software/flac3d>, 4 pages.
Itasca, "Fast Lagrangian Analysis of Continua," Version 7.0. Minneapolis, Minnesota, 2011, 22 pages.
Iyengar et al., "Analysis of Crack Propagation in Strain-Softening Beams," Engineering Fracture Mechanics, 2002, 69: 761-778, 18 pages.
Jose et al., "Continuous multi cycle nanoindentation studies on compositionally graded $Ti_{1-x}$, $Al_xN$ multilayer thin films," Materials Science and Engineering: A, Elsevier, Apr. 20, 2011, 528:21 (6438-6444), 7 pages.
Inaba et al., "Static Rock Splitter Using Shape Memory Alloy as Pressure Source," Journal of Mining and Materials Processing Institute of Japan, Jan. 1991, 4 pages.
Kelemen et al., "Petroleum Expulsion Part 2. Organic Matter Type and Maturity Effects on Kerogen Swelling by Solvents and Thermodynamic Parameters for Kerogen from Regular Solution Theory," Energy & Fuels, 2006, 20: 301-308, 8 pages.
Kolymbas, "Kinematics of Shear Bands," Acta Geotechnica, 2009, 4: 315-318, 4 pages.
Lam et al., "Experiments and Theory in Strain Gradient Elasticity," Journal of Mechanics and Physics Of Solids, 2003, 51: 1477-1508, 32 pages.
Larsen et al., "Changes in the Cross-Link Density of Paris Basin Toarcian Kerogen During Maturation," Organic Geochemistry, 2002, 33:1143-1152, 10 pages.
Lee et al., "An Analytical Study on Casing Design for Stabilization of Geothermal Well," Korean J. Air-Conditioning and Ref. Eng., 2012, 11:24, 16 pages.
L'homme, "Initiation of hydraulic fractures in natural sandstones," Master of Science in Geomechanics, University of Minnesota, PhD dissertation, Delft University of Technology, Delft, 2005, 281 pages.
Li et al., "Mechanical Characterization of Micro/Nanoscale Structures for MEMS/NEMS Applications using Nanoindentation Techniques," Science Direct, Ultramicroscopy, 2003, 97:481-494, 14 pages.
Liu, "Dimension effect on mechanical behavior of silicon micro-cantilver beams," Measurement, Oct. 2008, 41:8 (885-895), 11 pages.
Liu, "Micro-cantilver Testing to Evaluate the Mechanical Properties of Thermal Barrier Coatings," 19th European Conference on Fracture (ECF19): Fracture Mechanics for Durability, Reliability and Safety; Conference Proceedings held Aug. 26-31, 2012, Kazan, Russia, 7 pages.
Mahabadi et al., "A novel approach for micro-scale characterization and modeling of geomaterials incorporating actual material heterogeneity," Geophysical Research Letters, American Geophysical Union, Jan. 1, 2012, 39: L01303, 6 pages.
Mahabadi et al., "Development of a new fully-parallel finite-discrete element code: Irazu," ARMA-2016-516, American Rock Mechanics Association (ARMA), presented at the 50th US Rock Mechanics/Geomechanics Symposium, Jun. 26-29, 2016, 9 pages.
Mahmoud et al., "Removal of Pyrite and Different Types of Iron Sulfide Scales in Oil and Gas Wells without H2S Generation," IPTC-18279-MS, International Petroleum Technology Conference (IPTC), presented at the International Petroleum Technology Conference, Doha, Qatar, Dec. 6-9, 2015, 8 pages.
Maio et al., "Measuring Fracture Toughness of Coatings using Focused-ion-beam-machined Microbeams," Journal of Materials Research, Feb. 2005, 20:2, 4 pages.
Medlin et al., "Laboratory investigation of Fracture Initiation and Orientation," SPE-6087-PA, Society of Petroleum Engineers (SPE), Society of Petroleum Engineers Journal, Apr. 1976, 19:02, 16 pages.
Mitchell et al., "Chapter 7—Casing and Tubing Design," Properties of Casing and Tubing, Petroleum well construction, 1998, 40 pages.
Mohammed et al., "Casing structural integrity and failure modes in a range of well types—A review," Journal of Natural Gas Science and Engineering, 2019, 68: 102898, 25 pages.
Okiongbo et al., "Changes in Type II Kerogen Density as a Function of Maturity: Evidence from the Kimmeridge Clay Formation," Energy Fuels, 2005, 19: 2495-2499, 5 pages.
Oliver, "An Improved Technique for Determining Hardness and Elastic Modulus using Load and Displacement Sensing Indentation Experiments," Journal of Materials Research, Jun. 1992, 7:6, 20 pages.
Ortega et al., "The Effect of Particle Shape and Grain-Scale Properties of Shale: A Micromechanics Approach," International Journal for Numerical and Analytical Methods in Geomechanics, 2010, 34: 1124-1156, 33 pages.
Ortega et al., "The Effect of the Nanogranular Nature of Shale on their Poroelastic Behavior," Acta Geotechnica, 2007, 2: 155-182, 28 pages.

(56) References Cited

OTHER PUBLICATIONS

Ortega et al., "The Nanogranular Acoustic Signature of Shale," Geophysics, May-Jun. 2009, 74:3 (D65-D84), 20 pages.
Passey et al., "From Oil-Prone Source Rock to Gas-Producing Shale Reservoir—Geologic and Petrophysical Characterization of Unconventional Shale-Gas Reservoirs," SPE-131350, Society of Petroleum Engineers (SPE), presented at the CPS/SPE International Oil & Gas Conference and Exhibition, Beijing, China, Jun. 8-10, 2010, 29 pages.
Pittman, "Investigation of Abrasive-Laden-Fluid Method for Perforation and Fracture Initiation," SPE 1607-G, Society of Petroleum Engineers (SPE), presented at the 31st Annual California Regional Fall Meeting of SPE, Oct. 20-21, 1960, Journal of Petroleum Technology, May 1961, 13:5 (489-495), 7 pages.
Podio et al., "Dynamic Properties of Dry and Water-Saturated Green River Shale under Stress," SPE 1825, Society of Petroleum Engineers (SPE), presented at SPE 42nd Annual Fall Meeting, Oct. 1-4, 1967, Society of Petroleum Engineers Journal, Jun. 1968, 16 pages.
Poon et al., "An Analysis of Nanoindentation in Linearly Elastic Solids," International Journal of Solids and Structures, Dec. 2008, 45:24 (6018-6033), 16 pages.
Richard et al, "Slow Relaxation and Compaction of Granular Systems," Nature Materials, Feb. 2005, 4, 8 pages.
Shi et al., "Research and Application of Drilling Technology of Extended-reach Horizontally-intersected Well Used to Extract Coalbed Methane," 2011 Xi'an International Conference on Fine Geological Exploration and Groundwater & Gas Hazards Control in Coal Mines, Procedia Earth and Panetary Science, Dec. 2011, 3: 446-454, 9 pages.
Shin et al., "Development and Testing of Microcompression for Post Irradiation Characterization of ODS Steels," Journal of Nuclear Materials, 2014, 444: 43-48, 6 pages.
Sierra et al., "Woodford Shale Mechanical Properties and the Impacts of Lithofacies," ARMA 10-461, American Rock Mechanics Association (ARMA), presented at the 44th US Rock Mechanics Symposium and 5th US-Canada Rock mechanics Symposium, Jun. 27-30, 2010, 10 pages.
Slatt et al., "Merging Sequence Stratigraphy and Geomechanics for Unconventional Gas Shales," The Leading Edge, Special Section: Shales, Mar. 2011, 8 pages.
Slatt et al., "Outcrop/Behind Outcrop (Quarry), Multiscale Characterization of the Woodford Gas Shale," Chapter 12 in Shale-Reservoirs—Giant Resources for the 21st Century: AAPG Memoir, 2011, 97: 1-21, 22 pages.
Sone et al., "Mechanical Properties of Shale-Gas Reservoir Rocks—Part 1: Static and Dynamic Elastic Properties and Anisotropy," Geophysics, Sep.-Oct. 2013, 78:5 (D381-D392), 12 pages.
Sone et al., "Mechanical Properties of Shale-Gas Reservoir Rocks—Part 2: Ductile Creep, Brittle Strength, and their Relation to the Elastic Modulus," Geophysics, Sep.-Oct. 2013, 78:5 (D393-D402), 10 pages.
Ulm et al., "Material Invariant Poromechanics Properties of Shales," Poromechanics III: Biot Centennial, Proceedings of the 3rd Biot Conference on Poromechanics, 2005, 8 pages.
Ulm et al., "The Nanogranular Nature of Shale," Acta Geotechnica, 2006, 12 pages.
Vanlandingham, "Review of Instrumented Indentation," Journal of Research of the National Institute of Standards and Technology, Jul.-Aug. 2003, 108:4 (249-265), 17 pages.
Vernik et al., "Ultrasonic Velocity and Anisotropy of Hydrocarbon Source Rocks," Geophysics, May 1992, 57:5 (727-735), 9 pages.
Wang et al., "A Numerical Study of Factors Affecting the Characterization of Nanoindentation on Silicon," Materials Science and Engineering: A, Feb. 25, 2007, 447:1 (244-253), 10 pages.
Wang et al., "Iron Sulfide Scale Dissolvers: How Effective Are They?" SPE-168063-MS, Society of Petroleum Engineers (SPE), presented at the SPE Saudi Arabia section Annual Technical Symposium and Exhibition, Khobar, Saudi Arabia, May 19-22, 2013, 22 pages.
Wenk et al., "Preferred Orientation and Elastic Anisotropy of Illite-Rich Shale," Geophysics, Mar.-Apr. 2007, 72:2 (E69-E75), 7 pages.
Wilson et al., "Fracture testing of bulk silicon microcantilever beams subjected to a side load," Journal of Microelectromechanical Systems, Sep. 1996, 5:3, 9 pages.
Winkler et al, "Effects of borehole stress concentrations on dipole anisotropy measurements," Geophysics, Jan. 1998, 63:1 (11-17), 7 pages.
Wurster et al., "Characterization of the fracture toughness of microsized tungsten single crystal notched specimens," Philosophical Magazine, May 2012, 92:14, 23 pages.
Xi et al., "Uncertainty Analysis Method for Intersecting Process of U-Shaped Horizontal Wells," Arabian Journal for Science and Engineering, 40:2 (615-625), Feb. 2015, 12 pages.
Zeszotarski et al., "Imaging and Mechanical Property Measurements of Kerogen via Nanoindentation," Geochimica et Cosmochimica Acta, 2004, 68:20, 7 pages.
Zwanenburg et al., "Well Abandonment: Abrasive Jetting to Access a Poorly Cemented Annulus and Placing a Sealant," SPE-159216-MS, Society of Petroleum Engineers (SPE), presented at the SPE Annual Technical Conference and Exhibition, Oct. 8-10, 2012, 11 pages.
PCT International Search Report and Written Opinion in International Appln. No. PCT/US2021/061584, dated Mar. 24, 2022, 15 pages.
AlTammar et al., "Effect of Borehole Notch Properties on Breakdown Pressure," ARMA-2019-1830, Paper presented at the 53rd U.S. Rock Mechanics/Geomechanics Symposium, New York City, New York, Jun. 2019, 7 pages.

* cited by examiner

WELLBORE SHAPED PERFORATION ASSEMBLY

TECHNICAL FIELD

This disclosure relates to a wellbore tool, a shaped perforating system, and a method for producing a shaped perforation in a cased wellbore.

BACKGROUND

To improve productivity of oil and gas wells, hydraulic fracturing is used to enhance connectivity between hydrocarbon-bearing reservoir formations and wellbores. In many cases, in tight formations without fractures, flow of hydrocarbons from reservoir formations towards wellbores is difficult to achieve and sustain at required levels. Such formations often include tight sandstones, tight carbonates, and shale. Hydraulic fractures can be created in vertical and horizontal wells both in cased-perforated and open-hole well completions. Techniques to induce transverse hydraulic fractures from openhole wellbores include cutting circumferential notches: slots or 360° notches in the wellbore wall. In cased wellbores hydraulic fractures are designed to be induced from perforation clusters made in the casing tubing.

SUMMARY

A well tool is disclosed for generating a shaped perforation in a cased wellbore. The tool includes a tool body having at least one wall. The at least one wall defines an opening and defines an interior volume. A fluid channel of the tool body extends from the opening of the at least one wall into the interior volume of the at least one wall. A first perforation device of the tool body is configured to form a perforation tunnel in the cased wellbore disposed in a formation. A second perforation device of the tool body is coupled to the first perforation device and to the fluid channel. The second perforation device is configured to form the shaped perforation in the formation by flowing fluid received through the fluid channel to the formation through the perforation tunnel.

In some instances, the first perforation device is configured to form the perforation tunnel in the cased wellbore and the second perforation device is configured to form the shaped perforation in the formation by flowing fluid received through the fluid channel to the formation through the perforation tunnel in the same trip.

The second perforation device can include at least one jetting port in fluid connection with the fluid channel.

Some well tools further include a controller operable to control the first perforating device and the second perforating device. The controller can be arranged in the interior volume of the at least on wall of the tool body.

In some instances, the well tool comprises a turbine configured to convey fluid from the channel into the second perforation device. The turbine may be configured to increase the fluid pressure of the fluid exiting the fluid port.

Some well tools also have a motor operable to rotate the tool body. The first perforating device can include at least one jetting port in fluid connection with the fluid channel. In some embodiments, the fluid channel comprises a switching valve operable to flow fluid into the first perforation device or the second perforation device.

The well tool may include a power source arranged in the interior space or the at least one wall and operable to power the first perforating device, and the second perforating device.

In some embodiments, the tool body, the first perforation device, and the second perforation device are attached to a coiled tubing.

A method for generating a shaped perforation in a cased well bore is disclosed. The method includes actuating a first perforating device mounted to a tool body of a well tool to produce a perforation tunnel in a casing disposed in a wellbore formed in a formation. The method further includes, after creating the perforation tunnel using the first perforation device, aligning a second perforation device mounted to the tool body with the created perforation tunnel. The method also includes actuating the second perforation device to form a shaped perforation through the perforation tunnel.

In some embodiments, the method includes running the first perforation device and the second perforation device into the wellbore in the same trip.

In some methods, actuating the second perforating device comprises jetting a slurry into the perforation tunnel.

In some methods, the slurry is acid soluble.

Some methods further include jetting an acid solvent into the shaped perforation.

In some embodiments, actuating the first perforating device comprises jetting a slurry towards a casing of a wellbore. The slurry can be an abrasive slurry. In some methods, actuating a second perforating device of the body to place shaped perforation comprises measuring using a perforation measuring device and transmitting a perforation measurement to the controller.

Some methods include comparing the shaped perforation measurement to a predetermined threshold.

In some methods, actuating the second perforation device to form the shaped perforation through the perforation tunnel comprises actuating the second perforation device to form the shaped perforation having predetermined dimensions, through the perforation tunnel.

A wellbore tool assembly for generating a shaped perforation in a cased wellbore is disclosed. The wellbore tool assembly includes a well tool for generating a shaped perforation in a cased wellbore and a coiled tubing assembly. The well tool includes a tool body having at least one wall, a fluid channel, a first perforation device, and a second perforation device. The at least one wall of the tool body defines an opening and defines an interior volume. The fluid channel of the tool body extends from the opening of the at least one wall into the interior volume of the at least one wall. The first perforation device of the tool body is configured to form a perforation tunnel in the cased wellbore disposed in a formation. The second perforation device of the tool body is coupled to the first perforation device and to the fluid channel. The second perforation device is configured to form the shaped perforation in the formation by flowing fluid received through the fluid channel to the formation through the perforation tunnel. The coiled tubing assembly of the wellbore tool assembly is attached to the tool body. The coiled tubing assembly includes a coiled tubing connected to the opening of the fluidly connected to the fluid channel of the tool body. The coiled tubing assembly also includes a pump configured to convey the fluid in the coiled tubing.

In some embodiments, the second perforating device includes a turbine and a fluid port. The may be in fluid connection with the fluid channel of the tool body. Some fluid ports are arranged downstream of the turbine, fluidly connected to the turbine.

The system includes a wellbore tool having a first perforation device that produces a perforation tunnel in a casing and a second perforation device which protrudes this tunnel deeper into the rock and shapes it into pre-determined geometry and dimensions. The resulting shaped perforation tunnel can be formed in a single run or trip, without removal of the wellbore tool from within the wellbore. Fractures produced during fracturing may be generated at lower injection pressures and lower injection flow rate due to the presence and geometry of the shaped perforation tunnel.

The details of one or more embodiments are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

The present wellbore perforating system includes a well tool for forming a shaped perforation in a cased wellbore. The present perforating system can control the shape, size, and dimensions of one or multiple shaped perforations. The present perforating system has a wellbore tool that includes a first perforation device (for example, a perforator gun or sand jetting device) and a second perforation device (for example, a jetting device). In use, the first perforation device generates a perforation tunnel in the casing of the wellbore. A cable assembly (for example, a coiled tubing on a vehicle, a slickline, a wireline, downhole tractor or similar cable assembly) repositions the wellbore tool within the wellbore to align the second perforation device with the created perforation tunnel. The second perforation device then shapes the perforation tunnel into a shaped perforation having predefined dimensions, by jetting an abrasive slurry into the perforation tunnel. In some cases, the abrasive slurry can be dissolved by an acid solvent. Shaped perforations in the wellbore formed in this way prior to fracturing can lower the fracture initiation pressure, and therefore lower the breakdown pressure. The shaped perforations designate the locations at which transverse fractures will form during hydraulic fracturing. In some cases, the shaped perforations can also induce a predetermined transverse fracture orientation during fracturing.

Figure 1:
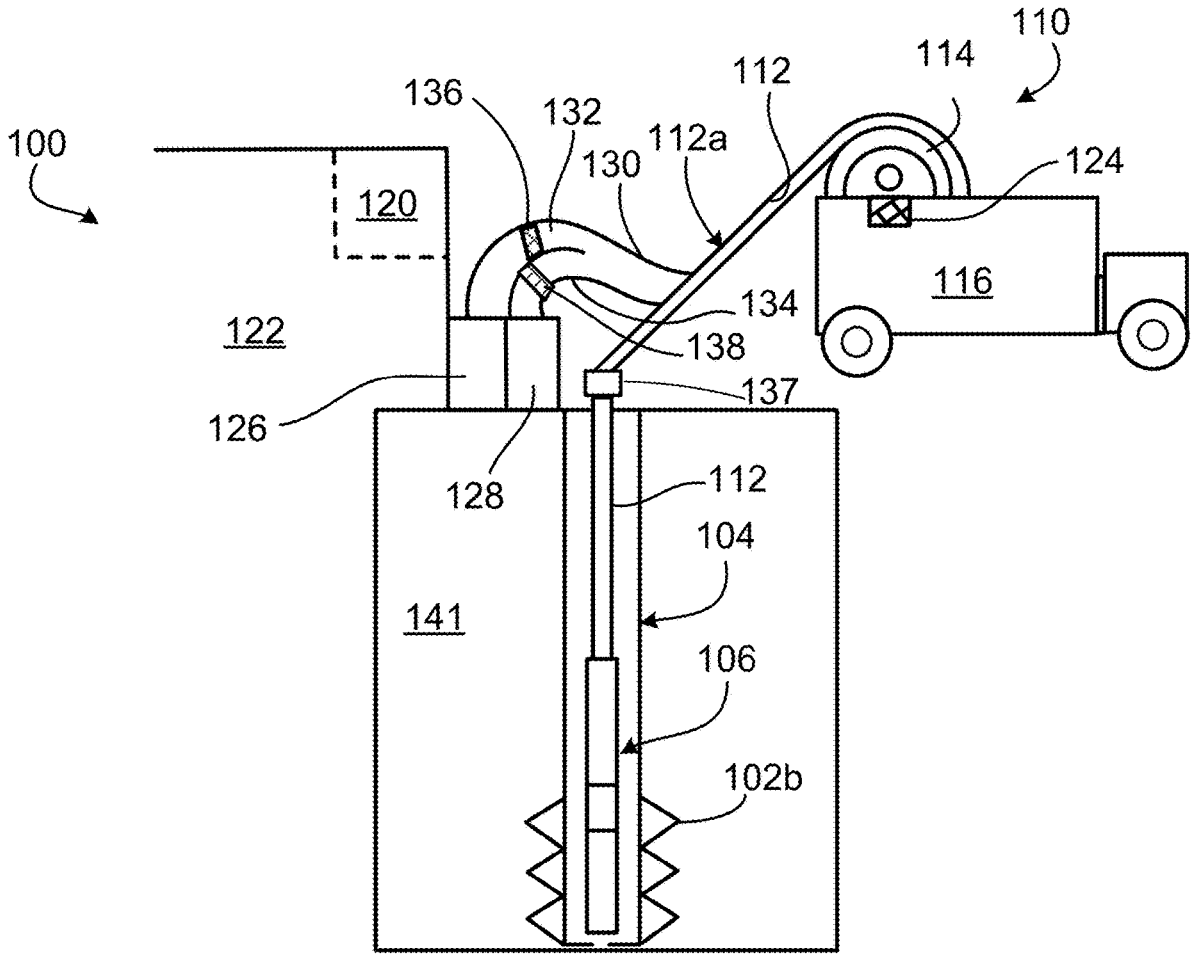
FIG. 1 is a perspective view of a system for generating a shaped perforation in a cased wellbore, the system having a device with a first perforating device and a second perforating device.
Figure 2A:
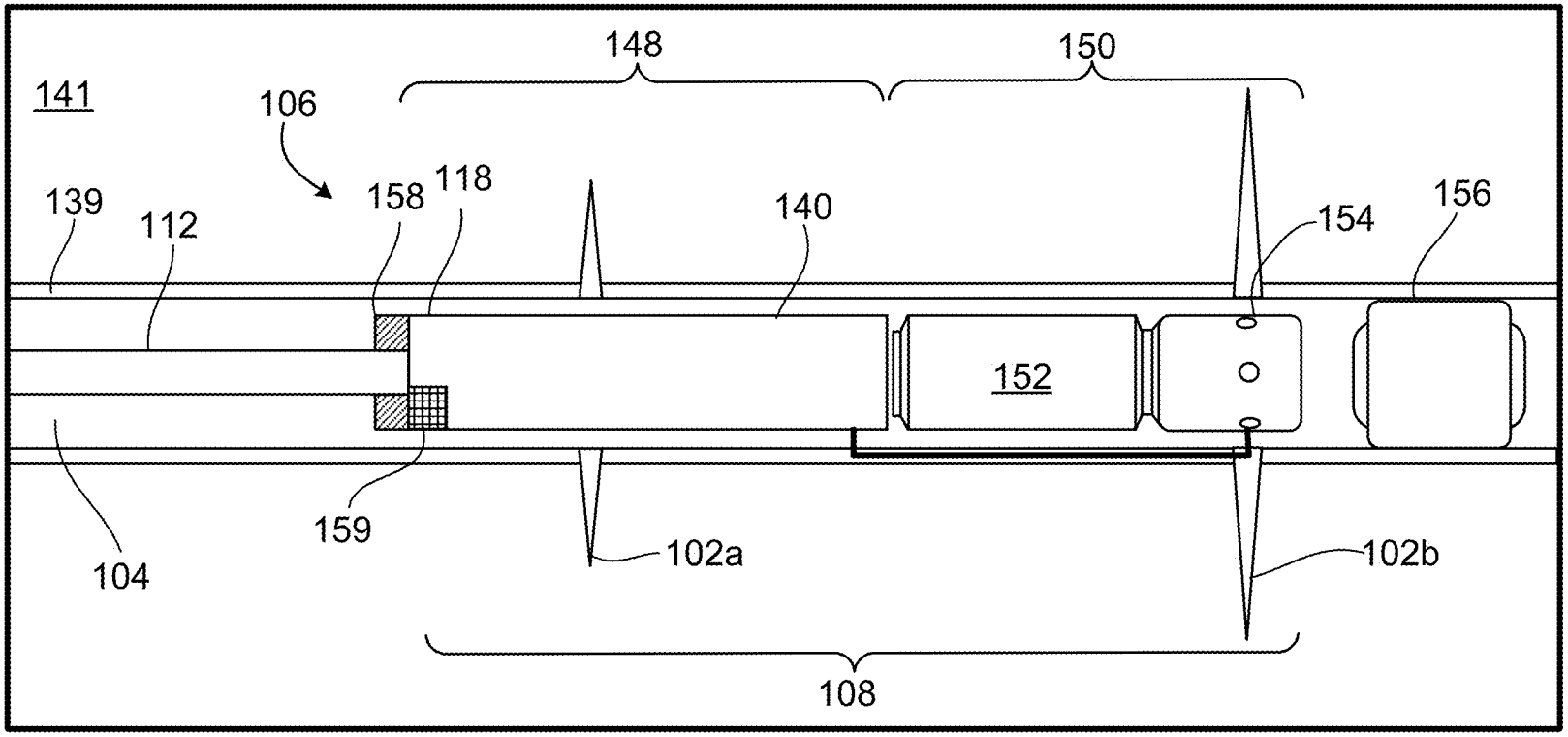
FIG. 2A is a side view of the device of the system in the cased wellbore

FIG. 1 shows a wellbore perforating system 100 for generating a perforation tunnel 102*a* (FIG. 2A) and for forming a shaped perforation 102*b* in the formation through the perforation tunnel 102*a* (FIG. 2A). The wellbore perforating system 100 is arranged in a cased wellbore 104 and includes a well tool 106 and a coiled tubing assembly 110. The coiled tubing assembly 110 includes a coiled tubing 112 arranged in a spool 114 on a vehicle 116. The coiled tubing 112 is hollow. One end of the coiled tubing 112 attaches to a connection end 118 (FIG. 2A) of the tool 106 (for example, an uphole end of the tool 106) and the other end of the tubing 112 attaches to the vehicle 116, or to another anchor on the surface. The tool 106 and the coiled tubing 112 are connected such that the tool 106 is rotatable relative to the coiled tubing 112 to reposition the jetting nozzle to another pre-defined azimuthal direction in order to allow placement of several discrete shaped perforations in the same transverse plane. Rotation of the spool 114 in a first direction or second direction translates the tool 106 downhole (Running into Hole (RIH) operation) or uphole (Pulling Out of Hole (POOH) operation), respectively. The spool 114 can be controlled manually or by a controller 120 of a computer system 122. In the system 100, the spool 114 is controlled by a tubing motor 124 arranged on the spool 114. The tubing motor 124 rotates in a first direction (RIH operation), rotates in a second direction (POOH operation), or stops, based on signals received from the controller 120. The tubing motor and controller may be in wired or wireless communication. Some tubing motors have a signal transceiver operable to send and receive signals from the controller. Some tools, may use additional downhole tractor modules to relocate the tool with high precision and to anchor the tool to the wellbore during the perforating and jetting tasks.

The coiled tubing assembly 110 also includes a slurry source 126 and an acid source 128 fluidly connected to the tool 106 via the tubing 112. A branch line 130 connects the slurry source 126 and the acid source 128 to a portion 112*a* of the tubing 112. The branch line 130 forks into a slurry line 132, connected to the slurry source 126, and an acid line 134, connected to the acid source 128. A slurry valve 136 is disposed on the slurry line 132 to control the flow of slurry to the tool 106. An acid valve 138 is disposed on the acid line 134 to control the flow of acid to the tool 106. The slurry valve 136 and the acid valve 138 are each controlled by the controller 120.

The coiled tubing assembly also includes a pump 127 arranged on tubing 112. The pump 127 is controlled by the controller. The pump 127 is operable to convey the acid or slurry from the acid source 128 or slurry source 126 to the tool 106 via the tubing 112. Some pumps include a signal transceiver operable to send and receive signals from the controller.

The slurry, housed in the slurry source 126, is an abrasive fluid that contains acid soluble particles. The abrasive particles in the slurry are dissolvable by an acidic solvent housed in the acid source 128. In some systems, the slurry includes particles that are thermally dissolvable. The slurry may contain solid particles with designed shapes such as spherical, cylindrical or irregular with a specific size distribution. The size distribution may be, suitable for flowing through the hollow coiled tubing 112. These particles are dissolvable or degradable under in-situ downhole conditions to prevent the tool from getting stuck in the wellbore and to prevent any screen-out or near wellbore issues when a fracturing treatment is started. For example, the particles might be made from calcium carbonate which can be dissolved by diluted hydrochloric acid (HCl) solution. Some particles of the slurry may be poly-lactic acid (PLA) which can degrade under downhole temperatures. Some slurries may include any other acid soluble compounds or particles that are (chemically and mechanically) compatible with the formation. Some acidic solvents include hydrochloric acid, or other known acid solvents.

FIG. 2A shows a side view of the tool 106 deployed in the cased wellbore 104 of a formation 141. A casing 139 extends around the perimeter of the wellbore 104, between the well tool 106 and the formation 141. The well tool (wellbore device) 106 has a tool body 108 that includes a cylindrical housing 140 defining an opening 142 (FIG. 2B) at the connection end 118 of the tool 106. The housing 140 also defines an interior volume 144. The tool body 108 further includes a fluid channel 146 (FIG. 2B) extending from the opening 142 (FIG. 2B) of housing 140 into the interior volume 144, a first perforation device 148, and a second perforation device 150. The first perforation device 148 is configured to form the perforation tunnel 102*a* in the cased wellbore 104 and the second perforation device 150 is configured to form the shaped perforation 102*b* in the formation 141 by flowing fluid received through the fluid channel to the formation through the perforation tunnel 102*a* in the same trip. By the "same trip," it is meant that both perforation devices can be mounted to the coiled tubing at the surface and lowered into the wellbore, and that each perforation device can be operated within the wellbore without needing to remove the coiled tubing out of the wellbore. In some tools, the tool body, the first perforation device, and a second perforation device are attached to the coiled tubing.

Figure 2B:
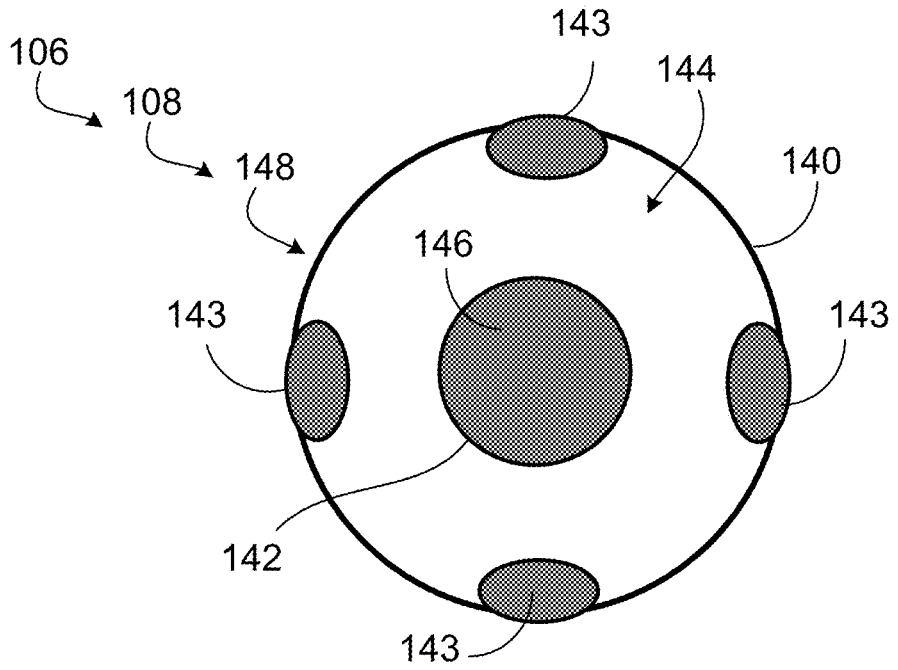
FIG. 2B is a cross sectional view of the first perforating device.

The first perforation device 148 of the tool 106, shown in FIGS. 2A and 2B, is mounted to the housing 140. In some tools, the first perforation device is part of the housing, rather than mounted on the housing. The first perforation device 148 forms the perforation tunnel 102*a* in the cased wellbore 104 using a mechanical or explosive force. The first perforation device may be a perforation gun, drill bit (e.g., side coring), a jetted sand slurry, or any other perforation device known in the art. The first perforation device 148 includes multiple shaped charges 143 (FIG. 2B) arranged in a pattern around the cylindrical housing 140. A cross sectional view of the first perforation device 148 and the fluid channel 146 is shown in FIG. 2B. The first perforation device 148 is controlled by the controller 120 and, when activated, triggers or discharges the shaped charges 143, which explode to generate the perforation 102*a* tunnel. That is, the explosive force of the shaped charges 143 impinges on the inner wall of the casing causing the perforation tunnel to be formed as through openings or holes in the casing. The perforation tunnel may be an opening in the casing 139 and the explosive force may further carry forth and impinge the formation 141. Generally, the perforation tunnel 102*a* is bluntly shaped and does not extend into a sharp point with predefined dimensions. The perforation tunnels 102*a* provide access to the formation 141 to form and further shape shaped perforations in the formation. In some systems, the first perforation device may include a signal transceiver operable to send and receive signals from the controller.

The second perforation device 150 of the tool 106 is mounted to the housing 140. In some tools, the second perforation device is part of the housing, rather than mounted on the housing. The second perforation device 150 is arranged downhole relative to the first perforation device 148. Due to this configuration, the tool uses Pulling Out of Hole (POOH) tool positioning techniques that are more stable than Running into Hole (RIH) tool positioning techniques. In some tools, however, the second perforation device is arranged uphole of the first perforation device and RIH positioning techniques may be used. The fluid channel 146 extends from the opening 142 of the housing 140 to a turbine 152 of the second perforation device 150. The turbine 152 is controlled by the controller 120 and acts as a downhole hydraulic motor to build up a jetting pressure of the fluid. The fluid flows from the fluid channel 146 to ports 154 (jetting nozzles) defined in the second perforation device 150. In some systems, the turbine conveys or partially conveys the fluid. The ports 154 are arranged on a boundary of the second perforation device 150 and are oriented to jet fluid from the turbine 152 to formation 141 or cased wellbore 104, depending on the alignment of the tool 106 relative to the perforation tunnel 102*a*. The ports 154 are arranged at a distance d from, the perforation guns. In some systems, the second perforation device may include a signal transceiver operable to send and receive signals from the controller 120.

The shaped perforating system 100 also includes an isolation plug 156 and a tool motor 158. The isolation plug 156 can be expanded to form a seal between the isolation plug 156 and the cased wellbore 104. The isolation plug 156 isolates an already-stimulated portion of the wellbore below from portions of the wellbore 104 and can be used in multistage fracturing stimulation.

The tool motor 158 is arranged on the connection end 118 of the tool 106 and is controlled by the controller 120 (FIG. 1). The tool motor 158 is attached to the tool 106 such that the motor is operable to rotate the first perforation device and the second perforation device. The tool motor 158 is powered by a power source 159 of the tool 106, arranged in the internal volume of the housing 104. Some power sources are arranged at the surface and connect to the tool by a cable. Some power sources are hydraulic fluids delivered to the tool by a coiled tubing. The tool motor 158 rotates the tool 106 relative to the cased wellbore 104 and relative to the coiled tubing 112. In some systems, the tool motor is attached to the first and the second perforation devices. In some systems, the tool motor is attached to the first or the second perforation device. In some systems, the tool motor may include a signal transceiver operable to send and receive signals from the controller.

Prior to deploying the shaped perforating system 100, the formation 141 below the downhole end of the system 100 can be fluidically isolated from the formation above the downhole end. Doing so can ensure that any debris resulting from deploying the shaped perforating system 100 does not fall to the bottom of the well. In some implementations, the isolation plug 156 (for example, a packer) can be mounted to the coiled tubing and carried downhole in the same trip as the two perforation devices. Upon reaching a target depth, the isolation plug 156 is deployed to seal off the formation downhole and is separated from the coiled tubing 112. Subsequently, the two perforation devices 148, 150 are operated as described previously. Also, after the shaped perforation has been placed into formation using the shaped perforating system, the isolation plug isolates the formation during the hydraulic fracturing operation.

Figure 3A:
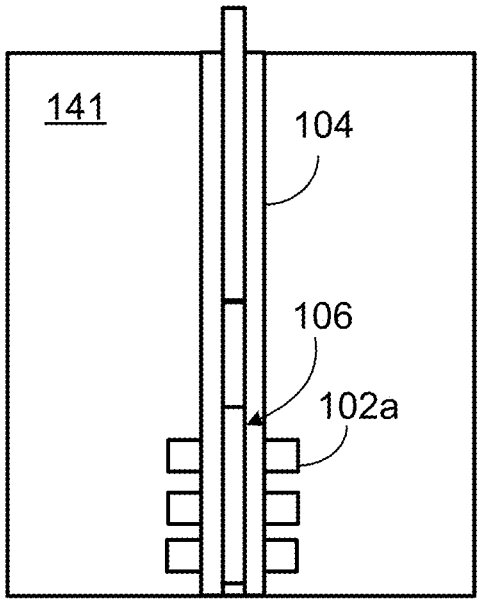
FIGS. 3A and 3B are side views of the tool in the cased wellbore in various stages of use.
Figure 3B:
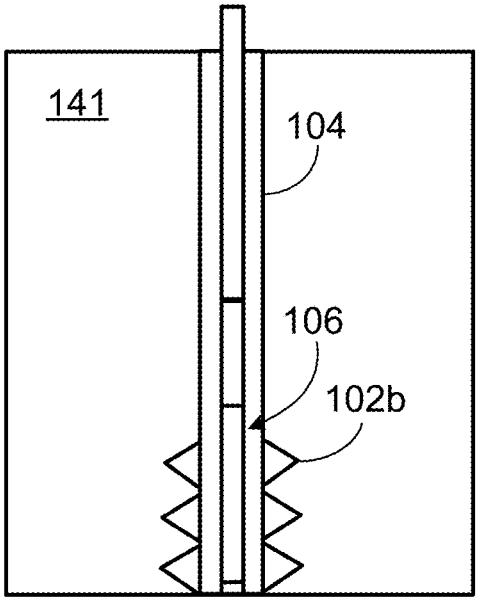

FIGS. 3A and 3B are cross-sectional views of the shaped perforating system 100 in various states during a fracturing operation. FIG. 3A is a side view of the shaped perforating system 100 after a perforation tunnel 102*a* has been generated by the first perforation device 148 (FIG. 2A) in the casing 139 (FIG. 2A). In this configuration, the acid valve 138 (FIG. 1) and the slurry valve 136 (FIG. 1) are closed and the first perforation device is aligned with the newly formed perforation tunnel 102*a*. The first perforation device 148 is aligned by rotating the spool 114 (FIG. 1) to fold or extend the coiled tubing 112 (FIG. 1), thereby moving the perforation device 148 attached to the coiled tubing 112 (FIG. 1), uphole or downhole. In some systems, the tool is positioned in the wellbore using the downhole tractor attached to the shaped tool. In some cases, the perforation tunnel is an opening in the casing that does not extend into the formation 141, but exposes the formation. In the perforation tunnel 102*a* that extends through the casing 139 (FIG. 2A) and partially into the formation 141, the perforation tunnel 102*a* is blunt and is not V-shaped.

FIG. 3B is a side view of the shaped perforation system 100 after the second perforation device 150 (FIG. 2A) formed the shaped perforation 102*b*. When shaping the perforation tunnel 102*a* or formation 141 through the perforation tunnel 102*a* (shaping configuration), the ports 154 (FIG. 2A) are in fluid connection with the slurry source 126 (FIG. 1) via the slurry line 132 (FIG. 1), the tubing 112 (FIG. 1), the fluid channel 146 (FIG. 3), and the turbine 152 (FIG. 2A). In this shaping configuration the slurry valve 136 (FIG. 1) is open and the acid valve 138 (FIG. 1) is closed. The turbine 152 (FIG. 2A) is operable to increase the fluid pressure of the slurry to a jetting pressure so that a high pressure slurry stream exits the ports 154.

The resultant shaped perforation 102*b* is "V-shaped" and may have specific dimensions designed based on the formation properties and stress conditions. The slurry is pumped down the coiled tubing to the jetting tool using the pump 127. Some pumps are surface coiled tubing pumps. The jetting pressure (injection rate) of the slurry exiting the ports 154 is based on the number of ports 154, an orifice diameter of the ports 154, a pump rate of the pump 127, and the pump rate of the turbine 152. Injection rate of slurry is determined based on the formation properties and strength.

The system 100 can then be removed and hydraulic fracturing operations can be performed. Prior to fracturing, the tool 106 is removed from the cased wellbore 104. A fracturing fluid flows though the cased wellbore at a high pressure and generates a fracture at the shaped perforation location or shaped perforation locations. In some systems, hydraulic fracturing fluid is pumped through the annulus between coiled tubing and casing without the need to remove the tool out of wellbore.

Figure 4:
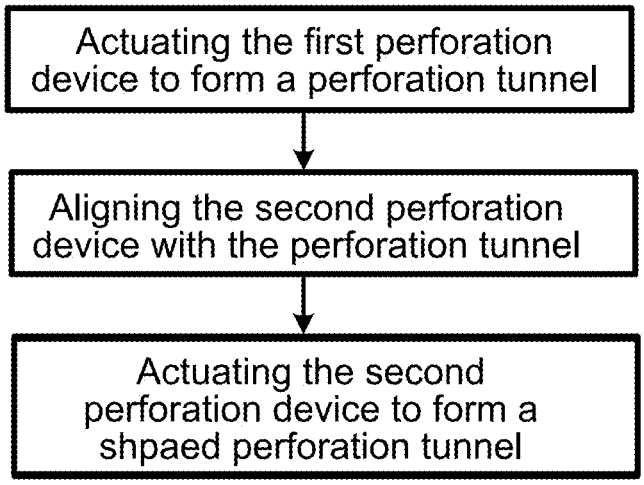
FIG. 4 is an example of a flow chart of a method for using the shaped perforation system.

FIG. 4 is a flowchart of a method 200 for using a shaped perforating system. The method will be described with reference to the shaped perforating system 100, however, the method 200 may be used with other shaped perforating systems. To use the shaped perforating system 100, a user or controller 120 determines the location at which a shaped perforation should be placed and the desired dimensions of the shaped perforation. Initially, the plug 156 is placed by the coiled tubing 112 in the wellbore 104 and the slurry valve 136 and the acid valve 138 are closed. The wellbore tool 106 is attached to the coiled tubing 112 and is deployed into the cased wellbore 104. The controller 120 instructs the coiled tubing reel motor 124 to rotate in a first direction (RIH operation) to axially translate the tool 106 downhole so that guns of the first perforation device 148 are aligned with the intended location of the shaped perforation. The tool motor 158 may rotate the tool 106 to align and/or orient the ports 154 with the intended location of the perforation tunnel. The controller 120 then actuates a first perforating device 148 mounted to the tool body 108 of a well tool 106 to produce the perforation tunnel 102*a* in the casing 158 deployed in a wellbore 104 formed in a formation 141. During actuation of the first perforating device 148, the guns are triggered to form the perforation tunnel 102*a*. The perforation tunnel 102*a* extends through the cased wellbore 104 (through the casing enclosed by the formation) and partially into the formation 141.

The tool 106 remains in the cased wellbore 104 during the entire operation of the shaped perforating tool assembly. The coiled tubing motor 124 is rotated in a second direction (POOH operation), opposite the first direction (RIH operation), to axially translate the tool 106 the distance d, uphole and align the ports 154 of the second perforation device 150 of the tool body 108 with the perforation tunnel 102*a*. The tool motor 158 may also rotate the tool 106 to align the ports 154 of the second perforation device 150 with the perforation tunnel 102*a*. In some systems, a downhole tractor module, connected to the controller, may also be used to precisely position of ports 154 of the second perforation device 150 opposite the perforation tunnel 102*a*.

Next, the second perforation device 150 of the tool body 108 is actuated to form and shape the shaped perforation 102*b*. The controller 120 opens the slurry valve 136 and actuates the turbine 152. The pump 127 conveys the slurry from the slurry source 126, through the slurry line 132, coiled tubing 112, the opening 142 of the wall 140, the fluid channel 146 of the tool 106, and out the ports 154 of the second perforation device 150. The slurry is conveyed at a high rate, so that the slurry jets out of the ports 154 and erodes the formation at the perforation tunnel 102*a*. The system does not rotate the tool but forms single point (discrete) shaped perforations aligned with each port 154.

The slurry jet precisely erodes the initial perforation tunnel 102*a* into a shaped perforation 102*b* that has the pre-determined dimensions. To form the shaped perforation with specific dimensions (diameter, depth, tip angle), jetting parameters can be altered. For example, the port (nozzle) orifice size, port (nozzle) angle, standoff distance, flow rate, and jetting time are each adjusted to affect the dimensions of the shaped perforation 102*b*. In some systems, an angle of the port relative to a vertical axis defined by the wellbore may be adjusted prior to jetting the slurry or while jetting the slurry.

After the shaped perforation 102*b* is formed to the desired shape and dimensions, the slurry valve 136 is closed and the acid valve 138 is opened. The acid source 128, acid line 134, tubing 112, turbine 152, and ports 154 are in fluid connection due to the opening of the acid valve 138. The pump 127 flows the acid solvent from the acid source 128 to the shaped perforation 102*b* via the ports 154 to dissolve any dissolvable slurry that retained in the shaped perforation 102*b* or settled in the wellbore. The acid solvent also dissolves slurry downhole of the tool 106, in the wellbore 104, regionally contained by the isolation plug 156.

After the shaped perforation 102*b* is formed and the slurry is cleared or dissolved from the wellbore 104, the coiled tubing reel motor 124 rotates the spool 114 in the second direction to bring the tool 106 to the surface (POOH operation). The system 100 is removed from the wellbore and hydraulic fracturing operations may be performed. A fracturing fluid flows though the cased wellbore at a high pressure and generates a fracture at the shaped perforation location or shaped perforation locations. In some systems, hydraulic fracturing fluid is pumped through the annulus between coiled tubing and casing without the need to remove the tool out of wellbore.

While the first perforation device has been described as a perforation gun, the first perforation device may also be an abrasive slurry jetting module. In such a well tool, the turbine is part of the well tool, rather than the second perforation device, and the turbine is operable to flow fluids in the first or second perforation device to increase the jetting pressure of a fluid. The turbine may be arranged uphole of both the first and the second perforation devices. The first perforation device is mounted to the housing of the well tool and includes nozzles (ports) in fluid connection with the fluid channel of the well tool. Some fluid channels may have a switching valve that directs the fluid flowing in the fluid channel to the ports of the second perforation device or the nozzles of the first perforation device. The switching valve is controlled by the controller.

The ports of the second perforation device and the nozzles of the first perforation device can be the same size and oriented at the same angles (relative to the vertical axis). In some instances, the ports of the second perforation device and the nozzles of the first perforation device are sized differently relative to each other and may be oriented at different angles (relative to the vertical axis). For example, the ports may have smaller openings than the nozzles so that the stream of fluid exiting the ports exerts a higher jetting pressure on the formation than the stream of fluid exiting the nozzles. In some instances, the nozzles have a smaller openings than the ports.

The shaped perforating system also includes an abrasive slurry source connected to the branch line by an abrasive slurry line. The abrasive slurry line is controlled by an abrasive slurry valve in communication with the controller. When the abrasive slurry valve is opened, the slurry source is in fluid communication with the abrasive slurry line, the tubing, the fluid channel of the well tool, the turbine, and the nozzles (ports) of the first perforation device. The abrasive slurry may be a sand-based slurry or any other abrasive slurry having an average particle size larger than the average particle size of the slurry (dissolvable by acid). Other common abrasive slurries may also be used. The abrasive slurry is jetted to form the perforation tunnel in the casing.

Operation with the first perforation device as an abrasive slurry jetting module is similar to the previously described method 200. To use the shaped perforating system, a user or controller 120 determines the location at which a shaped perforating should be placed and the desired dimensions of the shaped perforation. Initially, the slurry valve, the acid valve, and the abrasive slurry valve are closed. The coiled tubing places the isolation plug in the wellbore. The well tool is attached to the coiled tubing and is deployed into the cased wellbore to a predetermined depth by rotating the coiled tubing reel motor in the first direction (RIH operation). The tool motor may rotate the tool to align the ports of the first perforation device with the shaped perforation location. Once the controller determines that the tool is in the correct position, the tool motor anchors the tool in the axial position in the wellbore. The controller then actuates the first perforating device (abrasive slurry jetting module) mounted to the tool body of a well tool to produce the perforation tunnel in the casing installed in the wellbore. During actuation of the first perforating device, the controller opens the abrasive slurry valve and actuates the pump. The pump conveys the abrasive slurry from the abrasive slurry source, through the abrasive slurry line, coiled tubing, the opening of the wall, the fluid channel of the tool, the turbine, and out the nozzles of the first perforation device. The fluid pressure of the abrasive slurry increased by the turbine rate, so that the abrasive slurry jets out of the nozzles and erodes the casing of the wellbore, forming the perforation tunnel. The system does not rotate the tool while operating the first or second perforation device, and forms single point (discrete) tunnel perforations aligned with each nozzle of the first perforation device. The perforation tunnel extends through the casing and partially into the formation. The portion of the perforation tunnel that extends into the formation is blunt-tipped, dull, and/or nonuniform in shape and does not have a sharp "V-shape". In some cases, the perforation tunnel extends only through the casing.

The tool remains in the cased wellbore during the entire operation of the shaped perforating assembly. The tool motor unanchors the tool 106 from the wellbore and the coiled tubing reel motor is rotated in a second direction (POOH operation), opposite the first direction (RIH operation), to axially translate the tool the distance d, uphole and align the ports of the second perforation device of the tool body with the perforation tunnel. The tool motor may rotate the tool to align the ports of the second perforation device with the perforation tunnel. Once the controller determines that the tool is in the correct axial and rotational (azimuthal) position for shaping the perforation tunnel, the tool motor anchors the tool in the wellbore. The abrasive slurry valve is closed and the dissolvable slurry valve is opened. The dissolvable slurry includes abrasive particles to erode the perforation tunnel. The dissolvable slurry source, dissolvable slurry line, tubing, turbine, and ports of the second perforation device are in fluid connection due to the opening of the slurry valve.

Next, the second perforation device of the tool body is actuated and operated as described with reference to FIG. 4. The second perforation device erodes the initial perforation tunnel into shaped perforations by jetting the dissolvable slurry from the dissolvable slurry source to the formation. The system does not rotate the tool but forms single-point (or discrete) shaped perforation aligned with each port. The slurry valve is closed and the acid valve is opened. The acid source, acid line, tubing, turbine, and ports are in fluid connection due to the opening of the acid valve.

After the shaped perforation is formed to the desired shape and dimensions, the pump flows the acid solvent from the acid source to the shaped perforations via the ports to dissolve any dissolvable slurry retained in the shaped perforations. The acid solvent also dissolves slurry downhole of the tool, in the wellbore, regionally contained by the isolation plug. Some acid solvents also dissolve the abrasive slurry.

The coiled tubing reel motor rotates the spool in the second direction to bring the tool to the surface (POOH operation). The system 100 is removed from the wellbore and hydraulic fracturing operations may be performed. A fracturing fluid flows though the cased wellbore at a high pressure and generates a fracture at the shaped perforation location or shaped perforation locations. In some systems, hydraulic fracturing fluid is pumped through the annulus between coiled tubing and casing without the need to remove the tool out of wellbore.

In some well tools, the described second perforation device is the only perforation device mounted on the well tool. In such well tool, the perforation device is operable to flow an abrasive slurry, a (acid dissolvable) slurry, and an acid solvent through the ports of the perforation device. The system includes an abrasive slurry source connected to the branch line by a slurry line. The abrasive slurry line is controlled by an abrasive slurry valve in communication with the controller. When the abrasive slurry valve is opened, the slurry source is in fluid communication with the tubing, the fluid channel of the well tool, the turbine, and the ports of the perforation device. The abrasive slurry may be a sand based slurry or any other abrasive slurry.

To use the shaped perforating system with the single perforation device, a user or controller determines the location at which a shaped perforation should be placed and the desired dimensions of the shaped perforation. The isolation plug may be inserted into the wellbore using the coiled tubing. Initially, the slurry valve, the acid valve, and the abrasive slurry valve are closed. The wellbore tool is attached to the coiled tubing and is deployed into the cased wellbore to a predetermined depth by rotating the coiled tubing motor in the first direction (RIH operation). The tool motor may rotate the tool to align the ports of the perforation device with the shaped perforation location. Once the controller determines that the tool is in the correct position, the tool motor anchors the tool in the axial position in the wellbore. The controller then actuates the perforation device mounted to the tool body of a well tool to produce the perforation tunnel in the casing installed in a wellbore. During actuation, the controller opens abrasive slurry valve and actuates the pump. The turbine conveys the abrasive slurry from the abrasive slurry source, through the abrasive slurry line, coiled tubing, the opening of the housing, the turbine, the fluid channel of the tool, and out the nozzles of the perforation device. The abrasive slurry is conveyed at a high rate so that the abrasive slurry jets out of the ports and erodes the casing of the wellbore, forming the perforation tunnel. The system does not rotate the tool but forms single point (discrete) tunnel perforations aligned with each nozzle of the perforation device. The perforation tunnel extends through the casing and partially into the formation. The portion of the perforation tunnel that extends into the formation is blunt-tipped, dulled, and/or nonuniform in shape and does not have a sharp "V-shape". In some cases, the perforation tunnel extends only through the casing.

The tool remains in the cased wellbore, at the same axial position, during the entire operation of the shaped perforating assembly. The abrasive slurry valve is closed and the slurry valve is opened. The slurry source, slurry line, tubing, turbine, and ports of the perforation device are in fluid connection due to the opening of the slurry valve.

Next, the perforation device of the tool body is actuated by the controller and the turbine conveys the slurry from the slurry source to the ports. The perforation device forms the perforation tunnel into the shaped perforation by jetting the slurry from the slurry source to the formation. The system does not rotate the tool but forms single point shaped perforation aligned with each port. After the shaped perforation is formed, the slurry valve is closed and the acid valve is opened. The acid source, acid line, tubing, turbine, and ports are in fluid connection due to the opening of the acid valve.

The perforation device is actuated by the controller and the turbine flows the acid solvent from the acid source to the shaped perforations via the ports to dissolve any slurry that retained in the shaped perforations. The acid solvent also dissolves slurry downhole of the tool, in the wellbore, regionally contained by the isolation plug. Some acid solvents also dissolve the abrasive slurry. The tubing motor rotates the spool in the second direction (pulling out of hole (POOH) operation) to bring the tool to the surface.

Some systems can form multiple shaped perforation of varying dimensions in a single wellbore in a single run by adjusting the jetting parameters at different ports.

Some systems include a perforation measuring device, for example, a camera. In some cases, other physical imaging principals can be utilized, e.g., ultrasound imaging, infrared cameras, which can be used, for example, when the slurries or other fluids are slightly or completely opaque. The perforation measuring device is arranged on the tool body and periodically captures the perforation as the jetting slurry forms the shaped perforation. The perforation measuring device may include a transceiver operable to send and receive signals from the controller. The perforation measuring device or controller is able to determine the dimensions of the perforation and compare the dimensions to the predetermined dimensions set at the beginning of the operation. If the dimensions are within a threshold, the jetting is terminated. If the dimensions are below the threshold, the jetting is continued. The controller may alter any of the jetting parameters (port (nozzle) size, port angle, standoff distance, flow rate, jetting time) based on the measurements of the shaped perforation and/or the signals from the perforation measuring device. In some systems, the perforation measuring device may also confirm that ports are aligned with the perforation tunnel.

An acid source 128 and an acid line 134 controlled by an acid valve 138 has been previously described, however, in some systems, the acid solvent is flushed through the wellbore prior to fracturing. Such systems do not include the acid source, acid line, or acid valve.

In some systems, the second perforation device is rotatable relative to the first perforation device. In such a system, the tool motor attaches to the second perforation device.

A controller 120 arranged on a surface of the system has been previously described, however, the tool may also or alternatively include a controller arranged in the internal volume of the tool body.

A number of embodiments of the invention have been described. Nevertheless, it will be understood that various modifications may be made without departing from the spirit and scope of the invention. Accordingly, other embodiments are within the scope of the following claims.

What is claimed is:

1. A well tool for generating a shaped perforation in a cased wellbore, the tool comprising:

a tool body comprising:

a housing comprising:

at least one wall defining an opening, the at least one wall defining an interior volume; and a fluid channel extending from the opening of the at least one wall into the interior volume;

a first perforation device integrally formed with the housing, the first perforation device configured to form a perforation tunnel in the cased wellbore disposed in a formation; and a second perforation device integrally formed with the housing, the second perforation device coupled to the first perforation device and to the fluid channel, the second perforation device configured to form the shaped perforation in the formation by flowing fluid received through the fluid channel to the formation through the perforation tunnel when the second perforation device is aligned with the perforation tunnel.

2. The well tool according to claim 1, wherein the first perforation device is configured to form the perforation tunnel in the cased wellbore in a first trip and the second perforation device is configured to form the shaped perforation in the formation by flowing fluid received through the fluid channel to the formation through the perforation tunnel in the first trip.

3. The well tool according to claim 1, the second perforation device comprising at least one jetting port in fluid connection with the fluid channel.

4. The well tool according to claim 1 further comprising a controller operable to control the first perforating device and the second perforating device.

5. The well tool according to claim 1, wherein the well tool comprises a turbine configured to convey fluid from the channel into the second perforation device.

6. The well tool according to claim 5, wherein the turbine is configured to increase the fluid pressure of the fluid exiting the fluid port.

7. The well tool according to claim 1, wherein a controller is arranged in the interior volume of the body.

8. The well tool according to claim 1, further comprising a motor operable to rotate the tool body.

9. The well tool according to claim 8, wherein the first perforating device comprises at least one jetting port in fluid connection with the fluid channel.

10. The well tool according to claim 9, wherein fluid channel comprises a switching valve operable to flow fluid into the first perforation device or the second perforation device.

11. The well tool according to claim 1, further comprising a power source arranged in the interior space or the at least one wall and operable to power the first perforating device, and the second perforating device.

12. The well tool according to claim 1, wherein the tool body, the first perforation device, and the second perforation device are attached to a coiled tubing.

13. A method comprising:

actuating a first perforation device mounted to a tool body of a well tool to produce a perforation tunnel in a casing disposed in a wellbore formed in a formation;

after creating the perforation tunnel using the first perforation device, aligning a second perforation device mounted to the tool body with the created perforation tunnel; and actuating the second perforation device, mounted to the tool body, to form a shaped perforation through the perforation tunnel while the first perforation device is mounted to the tool body.

14. The method according to claim 13, further comprising running the first perforation device and the second perforation device into the wellbore in the same trip.

15. The method according to claim 13, wherein actuating the second perforating device comprises jetting a slurry into the perforation tunnel.

16. The method according to claim 15, wherein the slurry is acid soluble.

17. The method according to claim 16, further comprising jetting an acid solvent into the shaped perforation.

18. The method according to claim 13, wherein actuating the first perforating device comprises jetting a slurry towards a casing of a wellbore.

19. The method according to claim 18, wherein the slurry is an abrasive slurry.

20. The method according to claim 19, wherein actuating the second perforating device of the body to place shaped perforation comprises measuring using a perforation measuring device and transmitting a perforation measurement to the controller.

21. The method according to claim 20, further comprising comparing the shaped perforation measurement to a predetermined threshold.

22. The method according to claim 13, wherein actuating the second perforation device to form the shaped perforation through the perforation tunnel comprises:

actuating the second perforation device to form the shaped perforation having predetermined dimensions, through the perforation tunnel.

23. A wellbore tool assembly comprising:

a well tool for generating a shaped perforation in a cased wellbore, the tool comprising:

a tool body comprising:

a housing comprising:

at least one wall defining an opening, the at least one wall defining an interior volume; and a fluid channel extending from the opening of the at least one wall into the interior volume;

a first perforation device integrally formed with the housing, the first perforation device configured to form a perforation tunnel in the cased wellbore disposed in a formation; and a second perforation device integrally formed with the housing, the second perforation device coupled to the first perforation device and to the fluid channel, the second perforation device configured to form the shaped perforation in the formation by flowing fluid received through the fluid channel to the formation through the perforation tunnel when the second perforation device is aligned with the perforation tunnel; and a coiled tubing assembly attached to the tool body, the coiled tubing assembly comprising:

a coiled tubing connected to the opening of the wall, wherein the coiled tubing is fluidly connected to the fluid channel of the tool body; and a pump configured to convey the fluid in the coiled tubing.

24. The wellbore tool assembly according to claim 23, wherein the second perforating device comprises:

a turbine in fluid connection with the fluid channel; and a fluid port arranged downstream of the turbine, fluidly connected to the turbine.

* * * * *